US010051902B2

(12) United States Patent
Del Valle

(10) Patent No.: US 10,051,902 B2
(45) Date of Patent: Aug. 21, 2018

(54) HAND PERSPIRATION REMOVAL DEVICE

(76) Inventor: Edward M. Del Valle, Glendale Heights, IL (US)

( * ) Notice: Subject to any disclaimer, the term of this patent is extended or adjusted under 35 U.S.C. 154(b) by 1111 days.

(21) Appl. No.: 13/585,605

(22) Filed: Aug. 14, 2012

(65) Prior Publication Data

US 2014/0049004 A1 Feb. 20, 2014

(51) Int. Cl.
*A41D 20/00* (2006.01)
*A45F 5/04* (2006.01)

(52) U.S. Cl.
CPC ..... *A41D 20/00* (2013.01); *A45F 5/04* (2013.01); *A41D 2400/60* (2013.01)

(58) Field of Classification Search
CPC .... A41D 20/00; A41D 27/12; A41D 2400/60; A41D 13/08; A45F 2005/008; A45F 5/04; A41B 15/00; Y10T 24/1368
USPC ..... 2/1, 16, 20, 62, 160, 162, 170, 311, 312, 2/267, 910, 917; 221/185
See application file for complete search history.

(56) References Cited

U.S. PATENT DOCUMENTS 1,139,942 A * 5/1915 Wightman et al. .... B43M 11/04 118/201
2,301,881 A 11/1942 Kalenoff
2,636,175 A 4/1953 Hoffman, Jr.
3,045,245 A 7/1962 Kohen
3,174,156 A 3/1965 Dale et al.
3,760,461 A 9/1973 Wright
4,244,057 A * 1/1981 Burnham ..... A41D 19/0024 2/160
4,401,233 A * 8/1983 Frey ..... A45D 44/00 221/185
4,403,366 A 9/1983 Lucke
4,502,156 A * 3/1985 Wishman ..... A42C 5/02 2/171.2
4,536,889 A * 8/1985 Taylor ..... A44C 5/0046 2/160
4,542,751 A 9/1985 Webster et al.
4,698,854 A 10/1987 Slimmon
4,768,236 A 9/1988 Klob
4,771,478 A 9/1988 Bisagno et al.
5,012,543 A 5/1991 Lewis, Sr.
5,014,360 A 5/1991 Smith et al.
5,090,060 A 2/1992 Gates
5,127,545 A * 7/1992 French ..... A45F 5/00 221/102
D371,232 S * 7/1996 Fleming ..... D2/853
5,555,564 A 9/1996 Welch
D377,131 S 1/1997 Davis
(Continued)

FOREIGN PATENT DOCUMENTS

JP 10140409 A 5/1998
JP 11009753 A 1/1999
WO WO 2007053816 A2 * 5/2007 ..... A41D 1/04

*Primary Examiner* — Jameson Collier
(74) *Attorney, Agent, or Firm* — Henry C. Query, Jr.

(57) ABSTRACT

A hand perspiration removal device has a base which includes top and bottom surfaces, a perspiration absorbing pad which is removably attached to the top surface, and an arrangement for securing the base to a part of a user's body. The bottom surface of the base has a concave configuration which extends from a first side of the base to a second, opposite side of the base such that the bottom surface is configured to conform to the part of the user's body to which the device is secured.

39 Claims, 4 Drawing Sheets

(56) References Cited

U.S. PATENT DOCUMENTS 5,706,521 A 1/1998 Haney
5,724,698 A 3/1998 Mondragon
5,756,177 A 5/1998 Cheong
5,765,233 A 6/1998 Hayes
5,893,190 A 4/1999 Mertz
6,003,190 A 12/1999 Knudsen
6,145,129 A 11/2000 Czekalla et al.
6,243,867 B1 * 6/2001 Faison ..... A41D 13/08 2/16
6,820,281 B2 * 11/2004 Mariland ..... A41D 27/20 2/115
6,863,197 B1 * 3/2005 Dirlam ..... A47G 25/485 223/93
6,865,749 B2 3/2005 Mohney
7,735,682 B1 * 6/2010 Cassel ..... A47K 10/38 221/155
8,910,312 B1 * 12/2014 Apisa ..... A41D 27/12 2/170
2002/0084279 A1 * 7/2002 Lickstein ..... A47K 10/42 221/24
2004/0031120 A1 * 2/2004 Cherian ..... A41D 19/0024 15/227
2004/0251285 A1 * 12/2004 O'Neill ..... A45F 5/00 224/221
2006/0010576 A1 * 1/2006 Tse ..... A41D 27/12 2/244
2007/0067888 A1 * 3/2007 Manier ..... A41D 27/133 2/53
2007/0118943 A1 * 5/2007 Stockhamer ..... A41D 1/04 2/1
2007/0157355 A1 7/2007 Katsin
2007/0234466 A1 * 10/2007 Stengel ..... A41D 19/0024 2/160
2008/0052802 A1 * 3/2008 Bryan ..... A41B 9/06 2/54
2010/0064462 A1 3/2010 Lemler et al.
2010/0249684 A1 * 9/2010 Spitzer ..... A61F 5/0118 602/21
2010/0299796 A1 * 12/2010 Hashemian ..... A41D 27/133 2/53
2012/0036613 A1 * 2/2012 Calon ..... A42C 5/02 2/171
2013/0014312 A1 * 1/2013 Izkovitz ..... A44C 9/0069 2/160
2014/0173806 A1 * 6/2014 Fournier ..... A41D 20/00 2/170
2016/0143368 A1 * 5/2016 Rivard ..... A61F 13/126 604/385.03

* cited by examiner

HAND PERSPIRATION REMOVAL DEVICE

BACKGROUND OF THE INVENTION

The present invention relates to a device for removing perspiration from a person's hands. More specifically, the invention relates to such a device which allows, for example, a video game player to quickly and effectively remove perspiration from his hands without being distracted or having to interrupt play.

Most video games are played using a hand-held or a console-installed game controller. During long periods of play, a video game player's hands may tend to perspire, sometimes profusely. Such perspiration can be a distraction to the video game player and can cause his hands to slip from the controls. For serious video game players in high-stakes competitions, such results can be detrimental.

Although the video game player can attempt to dry his hands by wiping them on his clothes, this is not an ideal solution. For one thing, depending on the material from which the clothes are made, wiping his hands on his clothes may not completely dry his hands. Also, wiping his hands on his clothes can dampen and discolor the clothes. In addition, the movement required to wipe his hands on his clothes can distract his attention from the game.

SUMMARY OF THE INVENTION

In accordance with the present invention, these and other limitations in the prior art are overcome by providing a hand perspiration removal device having a base which includes a top surface and a bottom surface; a perspiration absorbing pad which is removably attached to the top surface; and means for securing the base to a part of a user's body.

The perspiration absorbing pad provides a comfortable yet effective surface on which the user can wipe his hands in order to remove the perspiration. In addition, since the pad is removable, it may be washed and reused. The base may be attached to a part of the user's body which is normally located very close to the game controller, such as the user's thigh. As a result, the user is not required to move his hands to any great extent in order to reach the pad. Thus, the act of drying his hands on the pad will not appreciably distract the user from the game.

In one embodiment of the invention, the bottom surface of the base comprises a concave configuration which extends from a first side of the base to a second, opposite side of the base. In this manner, the bottom surface of the base is configured to conform to the part of the user's body to which the device is secured. Thus, the base will fit comfortably on the user's thigh and will therefore not pose a distraction to play.

The bottom surface of the base may also comprise a recessed middle portion which extends between the first and second sides. In addition, the middle portion may comprise a number of generally parallel channels which extend between the first and second sides. The recessed middle portion serves in effect to raise the bottom surface from the user's thigh to thereby allow air to circulate between the base and the thigh, and the channels serve to increase this flow of air. The circulation of air between the base and the thigh will help prevent the user's thigh from perspiring and thereby increase the user's comfort.

In accordance with another embodiment of the invention, the top surface comprises a recess within which the pad is positioned. As a result, the top surface surrounds the pad to aid in retaining the pad on the base, thereby ensuring that the pad will remain attached to the base during repeated, vigorous wipings by the user.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE INVENTION

Figure 1:
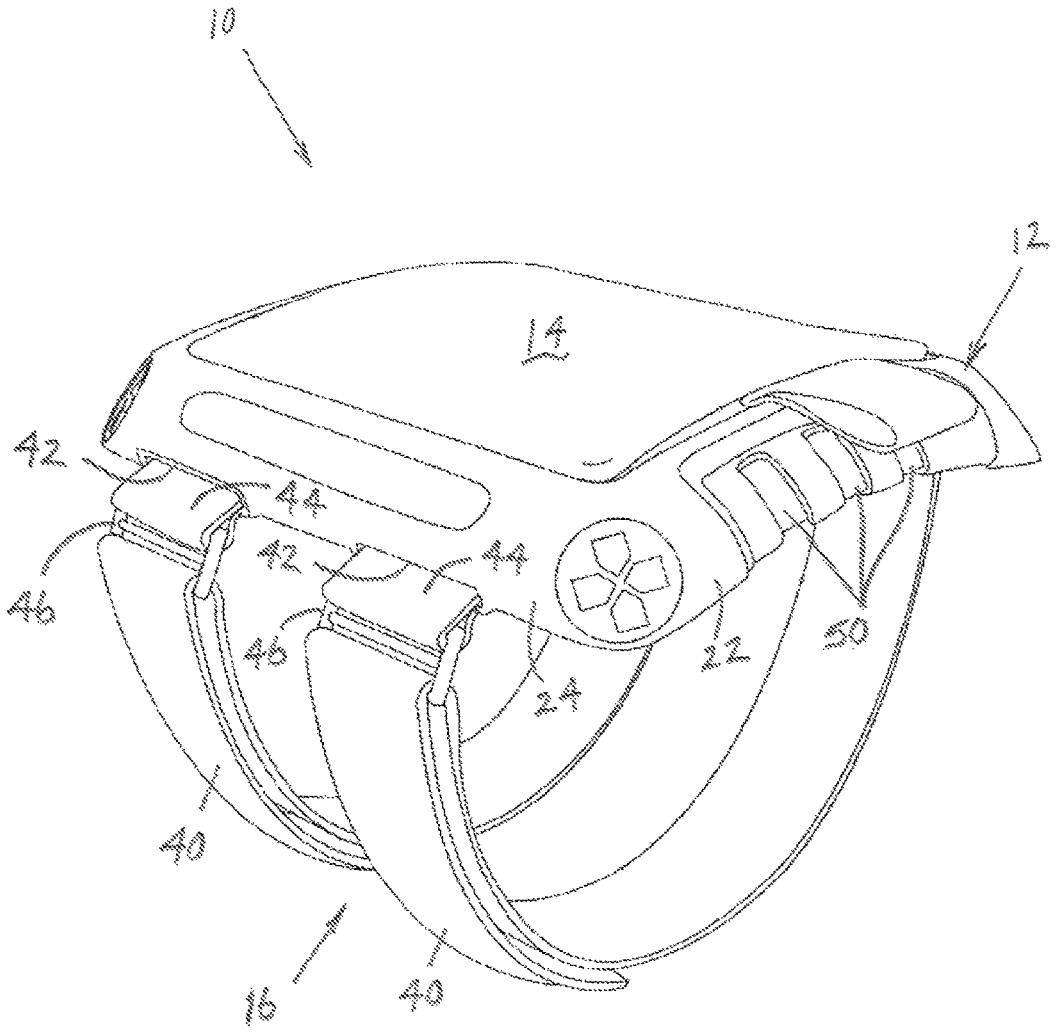
FIG. 1 is a perspective view of one embodiment of the hand perspiration removal device of the present invention.

Referring to the Figures, the hand perspiration removal device of the present invention, which in indicated generally by reference number 10, includes a base 12, a perspiration absorbing pad 14 which is removably attached to the base, and means, generally 16, for securing the base to a convenient part of a user's body, such as the user's upper thigh. As shown best in FIGS. 4-7, in one embodiment of the invention the base 12 is a generally rectangular member having a top surface 18, a bottom surface 20, and four side surfaces, namely, two generally parallel opposing side surfaces 22 and two generally parallel opposing side surfaces 24. In other embodiments of the invention, however, the base 12 may comprise any number of side surfaces, including one side surface, in which event the base would have a circular or oval configuration. The base 12 is ideally made from a washable, relatively stiff plastic material which will provide sufficient support for the pad 14 and be comfortable to wear when secured to the user's thigh.

Figure 2:
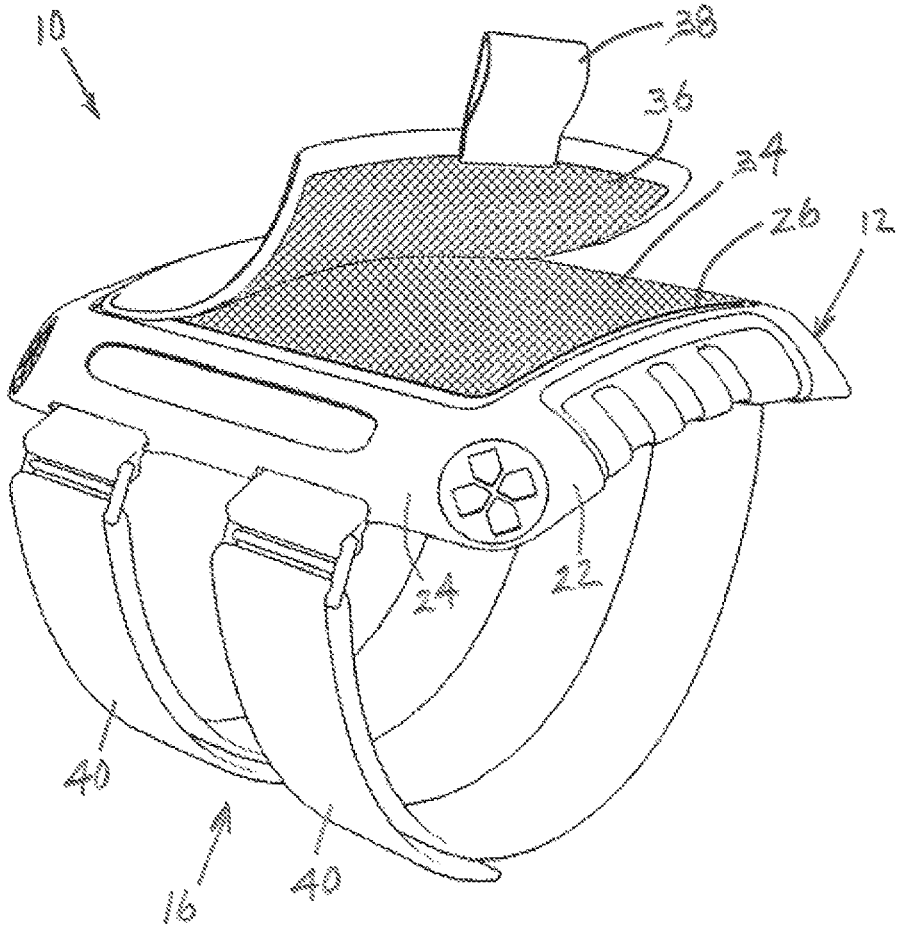
FIG. 2 is a perspective view of the hand perspiration removal device of FIG. 1 showing the perspiration absorbing pad component of the invention in a peeled-back position.

Referring to FIG. 2, the top surface 18 of the base 12 may comprise a generally rectangular recess 26 within which the pad 14 is positioned. The recess 26 comprises a depth which is preferably slightly less than the thickness of the pad 14. In this manner, the top surface of the pad 14 will extend slightly above the top surface 18 of the base 12 and provide ready access to the user without interference from the base. In addition, the top surface 18 of the base 12 will surround the periphery of the pad 14 to thereby ensure that the pad will remain attached to the base during repeated, vigorous wipings by the user.

Figure 3:
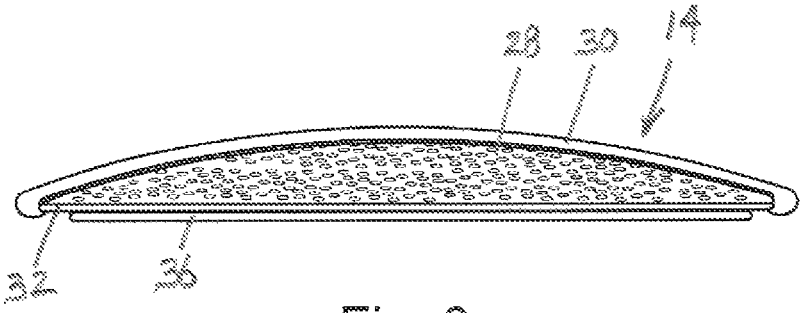
FIG. 3 is a cross sectional view of the perspiration absorbing pad.

As shown in FIG. 3, the perspiration absorbing pad 14 is comprised of an inner cushion 28 positioned between a top layer 30 and a base layer 32. The periphery of the top layer 30 is attached such as by sewing to the periphery of the base layer 32 to ensure that the inner cushion 28 remains covered by the top layer through repeated use of the pad 14. The cushion 28 is preferably made of a soft, resilient and washable material, such as a natural or synthetic sponge. The spring-like property of the cushion 28 maintains the top layer 30 in a fully expanded position, which ensures that a maximum surface of the top layer is available for the user to wipe his hands on. The top layer 30 is preferably made of a durable, absorbent and washable material. In a preferred embodiment of the invention, the top layer 30 is made from a microfiber material. Such a material will function to wick the perspiration removed from a user's hands away from the surface of the top layer 30, thus maintaining the surface of the top layer dry. The base layer 32 provides structural support for pad 14 and is therefore preferably made from a durable, relatively firm yet washable material, such as polyester, which may have a stiffness greater than that of the top layer. However, it should be understood that the base layer 32 could be made of the same material as the top layer 30.

The pad 14 may be removably attached to the base 12 by any suitable means. As shown in FIG. 2, for example, a hook and loop fastener, such as VELCRO® is used for this purpose. In this embodiment, a male VELCRO® fastener 34 is bonded to the floor of the recess 26 using, e.g., a suitable adhesive which is sufficiently durable to withstand washing in a household dishwashing machine. In addition, a female VELCRO® fastener 36 is attached such as by sewing to the outer surface of the base layer 32. In this manner, the fasteners 34, 36 will engage each other to ensure that the pad 14 is firmly secured to the base 12 but will enable the pad to be removed from the base so that it may be washed or replaced. Also, to facilitate the removal of the pad 14 from the base 12, the pad may be provided with a tongue 38, which may, e.g., be made of a loop of suitable material, such as nylon, that is sewn or otherwise attached to the base layer 32 of the pad.

In the embodiment of the invention which is shown in the Figures, the means 16 for securing the base 12 to the user comprises a number of straps 40, in this case two, which are made of a suitable material, such as ® nylon. Each strap 40 is inserted through a corresponding groove 42 which extends through the base 12 between the side surfaces 24. A first end of each strap 40 is formed into a loop 44 in which a corresponding buckle 46 is secured. As shown best in FIGS. 1 and 4, the opposite end of the strap 40 is adapted to be inserted through the buckle 46 and removably attached to an adjacent portion of the strap with, e.g., VELCRO® fasteners (not shown). In this manner, the length of the straps 40 between the base 12 may be adjusted to accommodate different size users.

Figure 4:
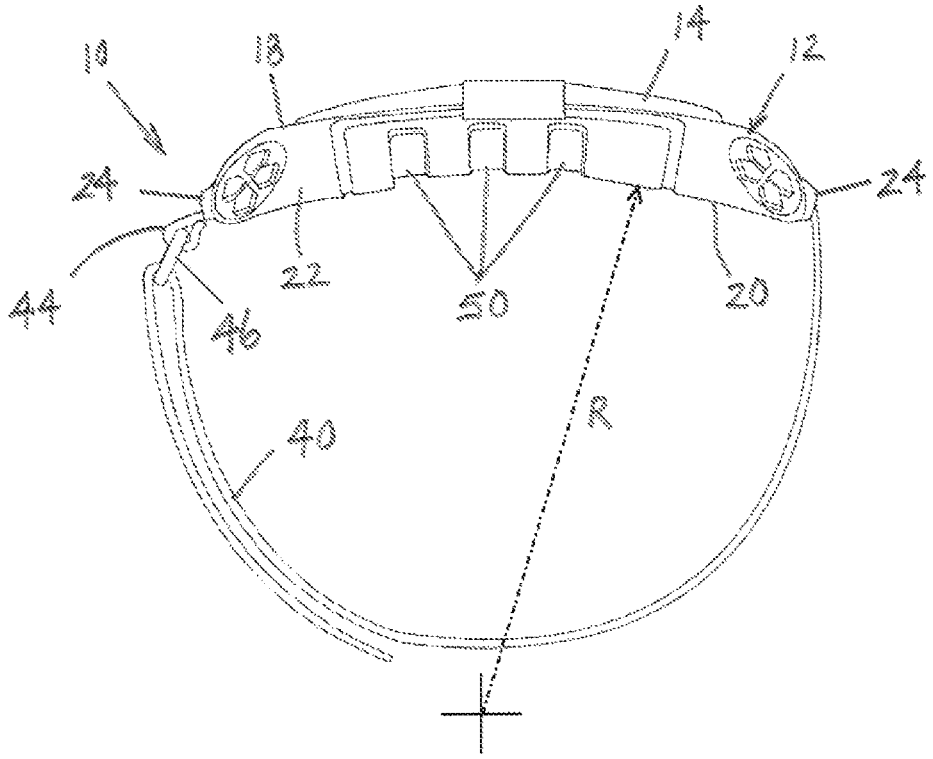
FIG. 4 is a front elevation view of the hand perspiration removal device of FIG. 1.
Figure 5:
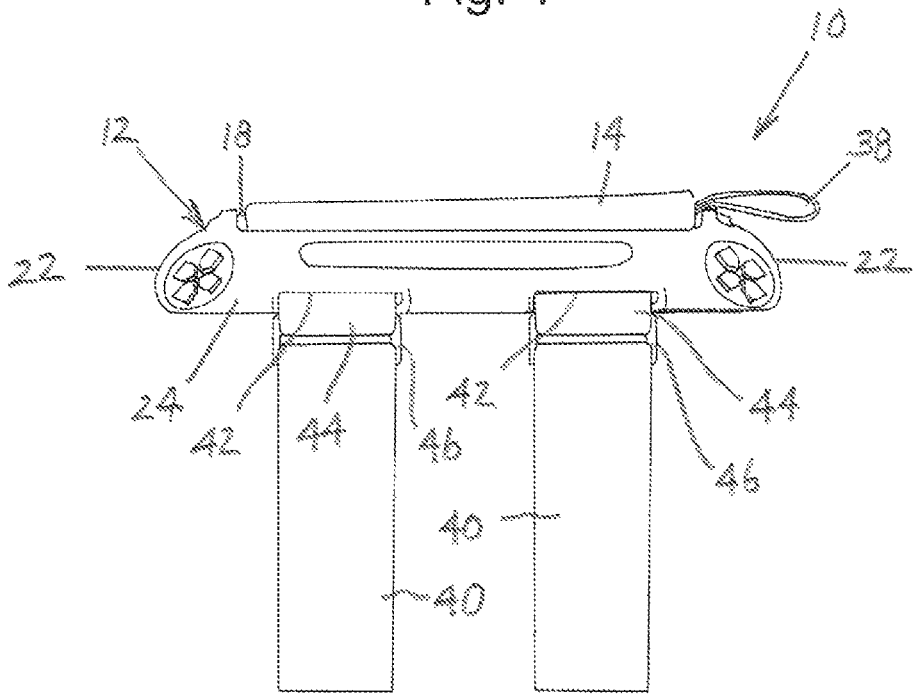
FIG. 5 is a side elevation view of the hand perspiration removal device of FIG. 1.
Figure 6:
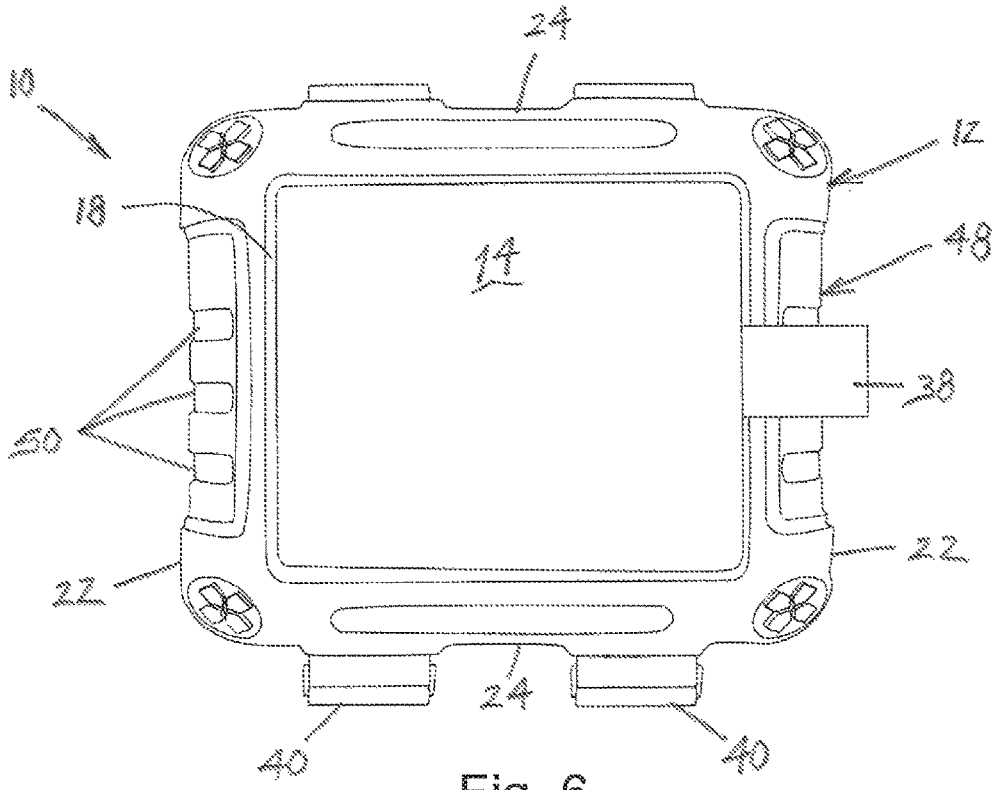
FIG. 6 is a top view of the hand perspiration removal device of FIG. 1.
Figure 7:
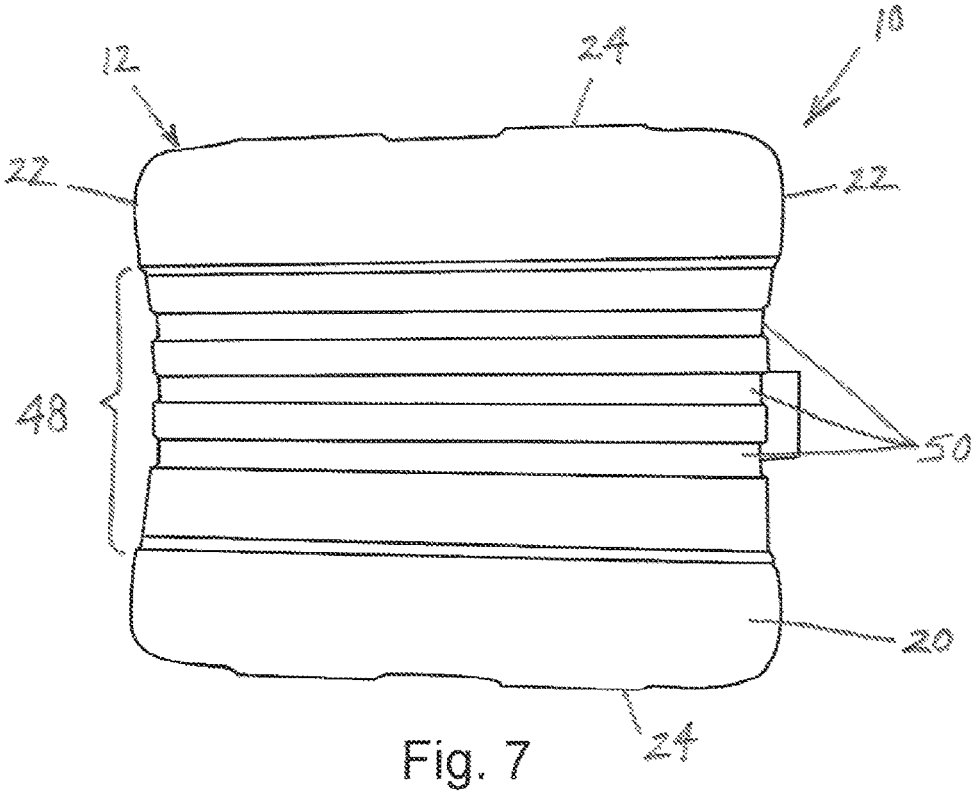
FIG. 7 is a bottom view of the base component of the hand perspiration removal device of FIG. 1.

Referring specifically to FIGS. 4, 6 and 7, the bottom surface 20 of the base 12 is preferably formed with a slight radius R to more comfortably conform to a user's upper thigh. In addition, the bottom surface 20 may comprise a recessed middle portion 48 which extends between and preferably also slightly up the sides 22. In this manner, when the device 10 is strapped to a user's thigh, the middle portion 48 will be raised slightly off of the user's leg to provide a less constricting fit and to allow air to circulate between the base 12 and the user's leg. Also, the middle portion 48 may be provided with a number of generally parallel channels 50 to further facilitate the circulation of air between the base 12 and the user's leg.

Although the base 12 has been described above as being comprised of a single piece of a relatively hard plastic material, in another embodiment of the invention the base may be constructed of two or more materials. For example, the lower half of the base 12 may be made of a soft, resilient material, such as rubber, which can more comfortably conform to the user's thigh while the upper half of the base may be made of the harder plastic material, which can bonded to the lower half using a suitable adhesive.

In use of the hand perspiration removal device 10, a video game player or other user secures the base 12 to his thigh using the traps 40. During play, as the player's hands become sweaty, the player can move one hand and then the other toward the device and wipe his fingers and palms on the perspiration absorbing pad 14. Due to the wicking nature of the top layer 30, the player's perspiration will be absorbed into the pad 14 and the outer surface of the top layer 30 will remain relatively dry, allowing for repeated use of the device 10 during play. When not in use, the pad 14 can be removed from the base 12 and washed, e.g., in a conventional clothes washing machine. In addition, the base 12 together with the straps 40 may be washed, e.g., in a household dishwashing machine. In this manner, the device 10 can be used time and again for its intended purpose.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A hand perspiration removal device which comprises:
a base which includes a top surface and a bottom surface;
a perspiration absorbing pad which is removably attached to the top surface; and
means for securing the base to a part of a user's body;
wherein the bottom surface of the base comprises a concave configuration which extends in a first direction from a first side surface of the base to a second, opposite side surface of the base, and a recessed middle portion which extends in a second direction from a third side surface of the base to a fourth, opposite side surface of the base, the recessed middle portion extending into the base and the second direction being generally perpendicular to the first direction;
whereby the bottom surface of the base is configured to conform to the part of the user's body to which the device is secured.

2. The hand perspiration removal device of claim 1, wherein the recessed middle portion comprises a plurality of generally parallel continuous channels which extend into the base and between the third and fourth side surfaces.

3. The hand perspiration removal device of claim 2, wherein the channels extend into the third and fourth side surfaces.

4. The hand perspiration removal device of claim 1, wherein the base is made from a stiff plastic material.

5. The hand perspiration removal device of claim 1, wherein the top surface of the base comprises a recess within which the pad is positioned.

6. The hand perspiration removal device of claim 5, wherein the recess comprises a depth which is less than the thickness of the pad such that a top surface of the pad extends above the top surface of the base.

7. The hand perspiration removal device of claim 1, wherein the pad comprises a top layer of material, a bottom layer of material and an absorbent cushion which is positioned between the top and bottom layers.

8. The hand perspiration removal device of claim 7, wherein the top layer is made from a microfiber material.

9. The hand perspiration removal device of claim 1, further comprising means for removably attaching the pad to the base.

10. The hand perspiration removal device of claim 9, wherein the means for removably attaching comprises a male hook-and-loop fastener which is attached to one of the base and the pad and a female hook-and-loop fastener which is attached to the other of the base and the pad.

11. The hand perspiration removal device of claim 10, wherein one of the male and female hook-and-loop fasteners is glued to the base and the other of the male and female hook-and-loop fasteners is sewed to the base layer of the pad.

12. The hand perspiration removal device of claim 9, further comprising a tongue member which is secured to the pad to facilitate removing the pad from the base.

13. The hand perspiration removal device of claim 1, wherein the means for securing comprises at least one strap which is connected to the base and is configured to be secured around the part of the user's body.

14. A hand perspiration removal device which comprises:
a base which includes a top surface and a bottom surface;
a perspiration absorbing pad which is removably attached to the top surface; and
means for securing the base to a part of a user's body;
wherein the top surface comprises a recess which extends into the top surface and within which the pad is positioned;
whereby the top surface surrounds the pad to thereby aid in retaining the pad on the base.

15. The hand perspiration removal device of claim 14, wherein the recess comprises a depth which is less than the thickness of the pad such that a top surface of the pad extends above the top surface of the base.

16. The hand perspiration removal device of claim 14, wherein the pad comprises a top layer of material, a bottom layer of material and an absorbent cushion which is positioned between the top and bottom layers.

17. The hand perspiration removal device of claim 16, wherein the top layer is made from a microfiber material.

18. The hand perspiration removal device of claim 14, further comprising means for removably attaching the pad to the base.

19. The hand perspiration removal device of claim 18, wherein the means for removably attaching comprises a male hook-and-loop fastener which is attached to one of the base and the pad and a female hook-and-loop fastener which is attached to the other of the base and the pad.

20. The hand perspiration removal device of claim 19, wherein one of the male and female hook-and-loop fasteners is glued to the base and the other of the male and female hook-and-loop fasteners is sewed to an outer surface of the base layer of the pad.

21. The hand perspiration removal device of claim 18, further comprising a tongue member which is secured to the pad to facilitate removing the pad from the base.

22. he hand perspiration removal device of claim 14, wherein the means for securing comprises at least one strap which is connected to the base and is configured to be secured around the part of the user's body.

23. The hand perspiration removal device of claim 14, wherein the base is made of a rigid material and the bottom surface of the base comprises a concave configuration extending in a first direction from a first side surface of the base to a second, opposite side surface of the base.

24. The hand perspiration removal device of claim 23, wherein the bottom surface of the base comprises a recessed middle portion which extends in a second direction from a third side surface of the base to a fourth, opposite side surface of the base, the second direction being generally perpendicular to the first direction.

25. The hand perspiration removal device of claim 24, wherein the recessed middle portion comprises a plurality of generally parallel channels which extend into the base and between the third and fourth side surfaces.

26. The hand perspiration removal device of claim 25, wherein the channels extend into the third and fourth side surfaces.

27. A hand perspiration removal device which comprises:
a base which includes a top surface, a bottom surface and a recess which extends into the top surface;
a perspiration absorbing pad which is removably attached to the base within the recess; and
means for securing the base to a part of a user's body;
whereby the top surface of the base surrounds the pad to thereby aid in retaining the pad on the base.

28. The hand perspiration removal device of claim 27, wherein the bottom surface of the base comprises a recessed middle portion which extends from a first side surface of the base to a second, opposite side surface of the base.

29. The hand perspiration removal device of claim 28, wherein the recessed middle portion comprises a plurality of generally parallel channels which extend into the base and between the first and second side surfaces.

30. The hand perspiration removal device of claim 29, wherein the channels extend into the first and second side surfaces.

31. The hand perspiration removal device of claim 27 wherein the recess comprises a depth which is less than the thickness of the pad such that a top surface of the pad extends above the top surface of the base.

32. The hand perspiration removal device of claim 27 wherein the pad comprises a top layer of material, a bottom layer of material and an absorbent cushion which is positioned between the top and bottom layers.

33. The hand perspiration removal device of claim 32, wherein the top layer is made from a microfiber material.

34. The hand perspiration removal device of claim 32 further comprising a tongue member which is secured to base layer to facilitate removing the pad from the base.

35. The hand perspiration removal device of claim 27, further comprising means for attaching the pad to a floor of the recess.

36. The hand perspiration removal device of claim 35, wherein the means for attaching comprises a male hook-and-loop fastener which is attached to one of the base and the pad and a female hook-and-loop fastener which is attached to the other of the base and the pad.

37. The hand perspiration removal device of claim 27, wherein the means for securing comprises at least one strap which is connected to the base and is configured to be secured around the part of the user's body.

38. A hand perspiration removal device which comprises:
a base which includes a top surface, a bottom surface and opposite first and second side surfaces; and
a perspiration absorbing pad which is removably attached to the top surface;
wherein the base comprises a plurality of generally parallel continuous channels which extend into the bottom surface and between the first and second side surfaces.

39. The hand perspiration removal device of claim 38 wherein the channels extend into the first and second side surfaces.

* * * * *